United States Patent [19]

Wright

[11] 4,221,009

[45] Sep. 9, 1980

[54] BATHING OR SHOWER APPARATUS

[76] Inventor: Howard S. Wright, 436 Devon St. West, New Plymouth, New Zealand

[21] Appl. No.: 958,662

[22] Filed: Nov. 8, 1978

[30] Foreign Application Priority Data

Nov. 9, 1977 [NZ] New Zealand ..... 185653

[51] Int. Cl.[3] ..... A47K 3/06

[52] U.S. Cl. ..... 4/566

[58] Field of Search ..... 4/177, 177 CW, 185 L, 4/159, 1

[56] References Cited

U.S. PATENT DOCUMENTS

| | | | |
|---|---|---|---|
| 3,187,350 | 6/1965 | Steven | 4/177 |
| 3,246,346 | 4/1966 | Schmidt | 4/177 |
| 3,334,360 | 8/1967 | Hoxeng et al. | 4/177 |
| 3,477,069 | 11/1969 | Stiger | 4/185 L |
| 3,557,392 | 1/1971 | Schmidt | 4/177 |
| 3,755,830 | 9/1973 | Johns | 4/177 |
| 3,800,336 | 4/1974 | Hoxeng | 4/177 |
| 3,801,995 | 4/1974 | Adamson | 4/185 L |
| 3,803,642 | 4/1974 | Erling et al. | 4/177 |

FOREIGN PATENT DOCUMENTS

| | | | |
|---|---|---|---|
| 488562 | 6/1977 | Australia | 4/177 |
| 15452 | 1/1978 | Australia | 4/177 |

*Primary Examiner*—Henry K. Artis

[57] ABSTRACT

A bath or shower apparatus which has a platform and a flexible cover attached thereto. The cover extends beyond the periphery of the platform and is attached at its outer edge to a surround which extends about the platform. Means are provided whereby the platform can be raised and lowered with respect to the surround. When the platform is lowered the flexible cover forms a continuous wall between the surround and platform. The flexible cover forms a continuous guttering between the surround when the platform is in the raised position.

13 Claims, 10 Drawing Figures

BATHING OR SHOWER APPARATUS

Figures 1, 2:
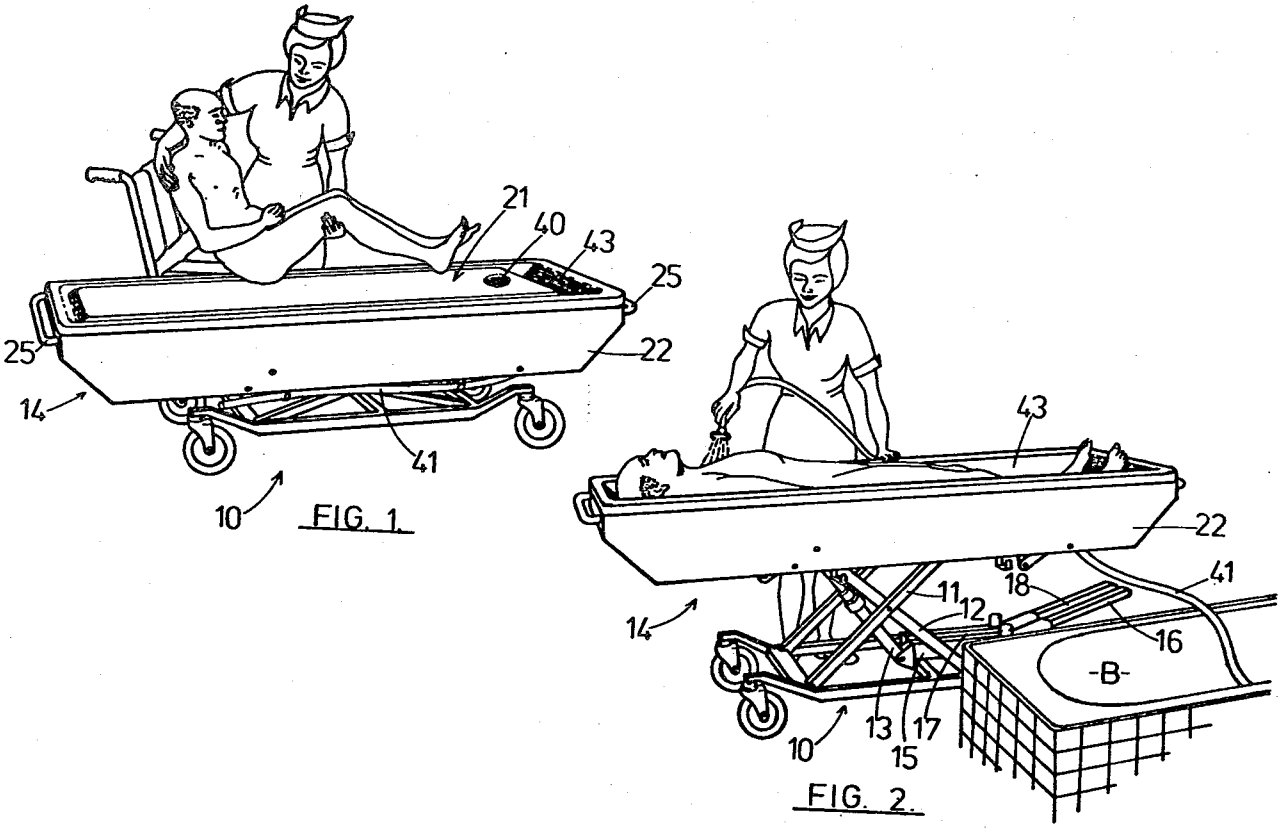

This invention relates to bathing or shower apparatus of the type which is more especially designed for use in hospitals, nursing homes or like institutions.

The type of apparatus to which the present invention relates to commonly known as a shower or bath trolley and for ease of reference the following disclosure will, in the main, relate to a shower trolley. Generally this equipment has a platform onto which a patient can be loaded whereupon a trough or similar arrangement can be provided around the patient to provide both a water container and splash guard. A patient supported by the platform can then be showered or in fact bathed by submersion. This equipment can either be a fixture in a bathroom or more commonly is mounted on a trolley so that it can be taken direct to the bed of the patient.

One known type of shower trolley employs several pieces of moulded fiberglass, the main piece being a platform on which the patient is placed whilst the auxiliary pieces attach thereto and hinge up to become, on the one hand splash boards, and on the other hand gutters which carry away to one discharge point all of the water applied by a shower nozzle. According to a second known type a canvas or fabric trough is sewn to a perimeter of a metal tube. In this case the patient is placed on a platform surface that already has the collapsed trough thereon. After positioning the patient the perimeter of the trough is raised so that it becomes a water container and splash guard. This type of shower trolley allows a patient to be showered or in fact bathed by submersion but it has the disadvantage that it is difficult to turn the patient to expose his or her back and is difficult to dry and cleanse between use by different patients.

A further known type of shower trolley employs a water-resistant mattress mounted on a platform. When side and end barriers are raised the perimeter of the mattress is raised leaving the centre depressed. There is a drain located in the depressed area to discharge water.

A common fault with all these known types of shower trolley is that several actions must be taken to build up a water proof barrier around the patient. Another disadvantage is that because they all employ a level platform surface much residual water is unable to drain away and must be mopped up while the patient is being dried. This problem is compounded when the material containing the water is loose and subject to puckering and folding.

The main purpose behind this type of equipment is to save nurses and attendants much heavy lifting when transferring patients from their beds or wheelchairs prior to and after bathing. It also allows the attendant to bath a patient at a working height that is more convenient than the conventional bath. The shower trolley therefore has useful application for long-stay patients in surgical, medical and orthopaedic wards and almost general application for geriatric patients.

Although the equipment as referred to in this specification is described as being mounted on a trolley, it could well be a fixture within a bathroom. In trolley form it can be regarded as a piece of bathroom equipment which occasionally leaves the room to transfer patients directly from their beds, but in the main patients would be brought to it by wheelchair. The shower trolley is essentially for nonambulant patients who depend on other people's assistance in the bathroom. In particular it is to make that assistance an easy task that can be performed by nurses or attendant who are small in stature even though the patient may be heavy.

In the description of the invention which hereinafter follows the equipment is shown as a shower trolley, i.e. is moveable. Its purpose is to be loaded with a patient at a conveniently low level and at that point present the patient with a level padded surface to lie down on. This surface is then raised to a working height that is convenient for the nurse or attendant. The level surface is then changed in form lowering the patient into a depression that has a sloping bottom equipped with a drain. The perimeter of the previously level platform surface remains in place to form a barrier or dam round the patient. This perimeter physically restrains the patient allowing him or her to be turned over with safety and provides a sense of security in the patient. It also deflects sprayed and splashed water keeping it within the perimeter and channelling it to the drain at the lowest point under the patient's feet.

Ancillary equipment which is necessary is a source of warm water delivered via a flexible hose to a shower nozzle and a drain to receive the exhausted water. The drain can be an existing bath or shower base.

After the patient is showered, the sloping platform on which he or she is lying is elevated to the level position and the patient can then be dried. After this the whole platform is lowered to allow the patient to be either transferred to a wheelchair or allowed to stand up. The trolley has large wheels and is very mobile so as to facilitate movement to the wards where patients who must remain in the supine position can be transferred directly from the bed Accordingly, in its broadest form the invention consists of a bath or shower apparatus comprising a platform, a flexible cover attached to said platform and extending beyond the periphery thereof, a surround which extends about said platform and to which the said cover is also attached and means to raise and lower said platform with respect to the surround.

Figure 3:
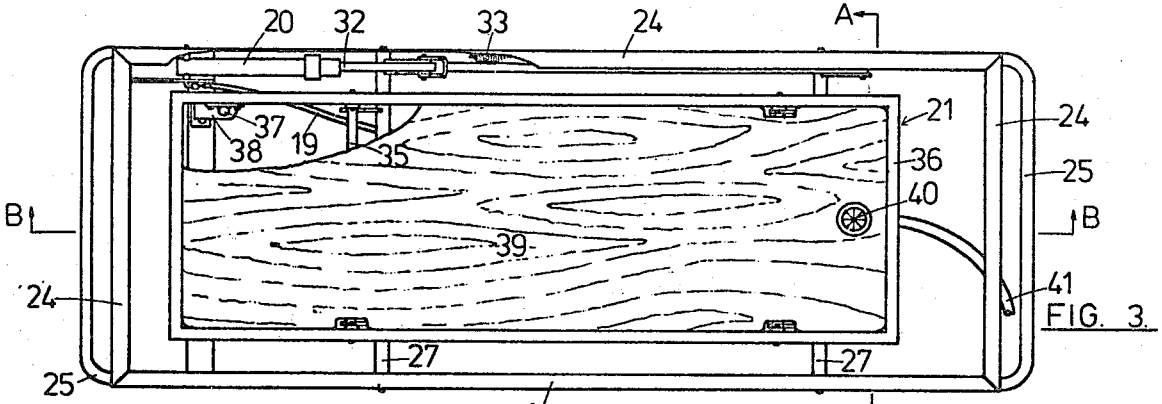
Figure 4:
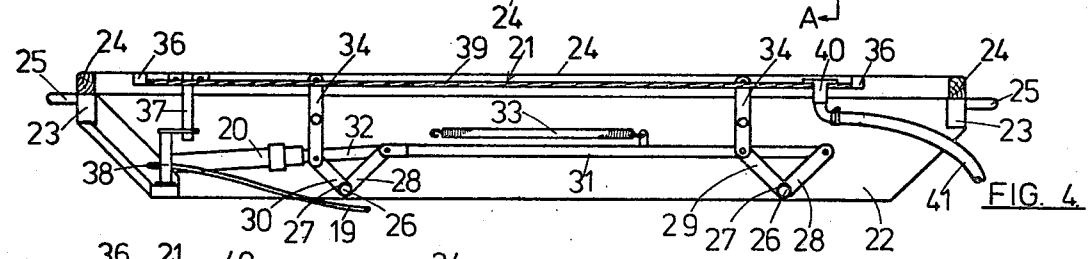
Figure 5:
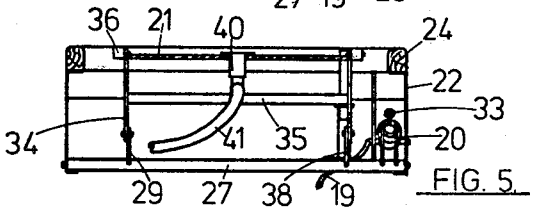
Figure 7:
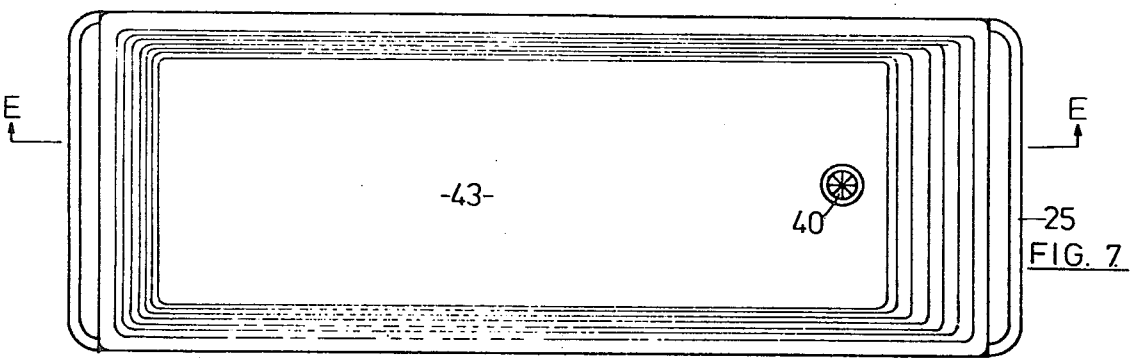
Figure 8:
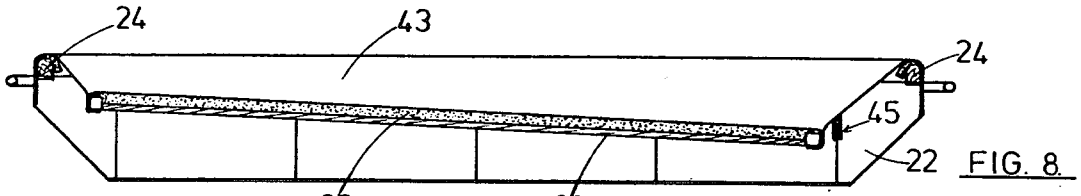
Figure 6:
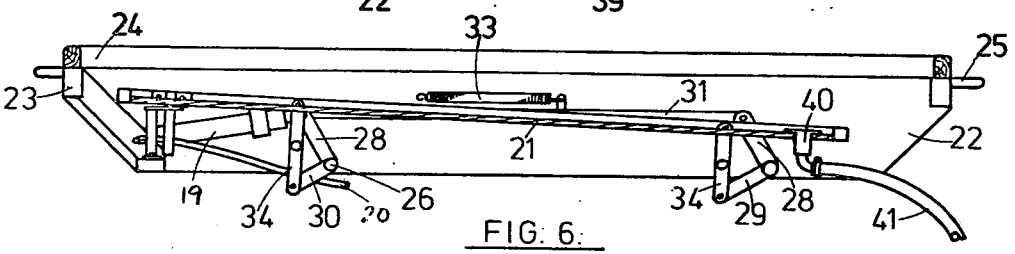
Figure 9:
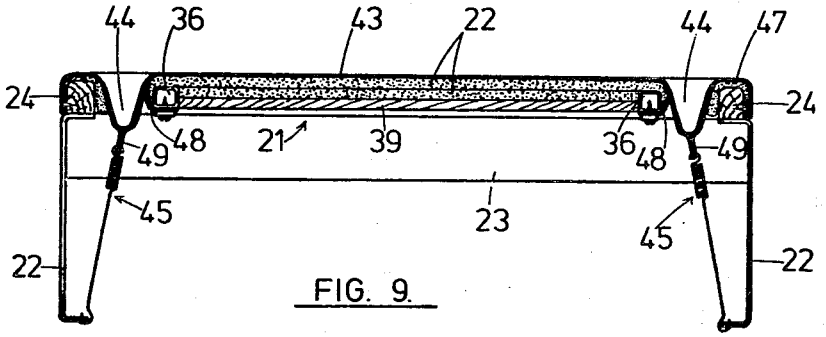
Figure 10:
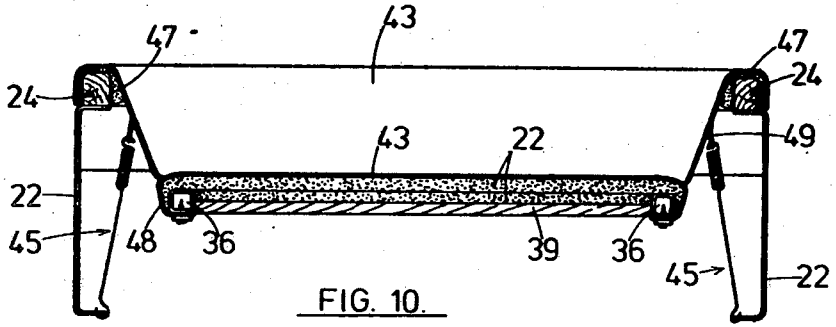

In more fully describing the invention according to its preferred embodiment reference will be made to the accompanying drawings in which:

FIG. 1 is a perspective view of the shower trolley according to the invention in its lowered position, FIG. 2 is a perspective view similar to that of FIG. 1 showing the trolley in its raised position with a patient in position for showering, FIG. 3 is a top plan view of the trolley platform with the cover excluded and some portions cut away, FIG. 4 is a sectional side elevation on the line B—B, FIG. 5 is a sectional end elevation on the line A—A, FIG. 6 is a similar view to FIG. 4 but with the platform in its lowered position, FIG. 7 is a top plan view with the platform lowered this time showing the cover in place, FIG. 8 is a sectional side elevation on the line E—E, FIG. 9 is a mid-length cross section of the platform showing the configuration of the cover when the platform is raised, and FIG. 10 is a similar view to that of FIG. 9 but with the platform lowered.

The lower part of the trolley is a conventional high-low bed bogey 10 employing an X linkage having arms 11 and 12 and an hydraulic pump 13 to effect the raise and fall of the platform unit 14. It will be appreciated that the bogey 10 and X linkage 11,12 together with pump 13 are of conventional design and platforms raised and lowered with this form of linkage are known from my earlier patent specifications. With known X linkages which provide a tilting function the linkage may be slightly modified as normally no tilting is required.

The pump unit 15 for ram 13 is centrally located with its operating pedal 16 accessible from the foot end of the trolley. Pump 15 with integral ram 13 is in the preferred form able to raise and lower the platform unit from a low position of 570 mm to a high position of 870 mm.

A second pump unit 17 is placed along side the elevation pump 15 and has its operating pedal 18 adjacent earlier described pedal 16. Pump unit 17 is connected to a remote ram 19 by a flexible hose 20. The purpose of ram 19 is to facilitate lifting and lowering of platform 21.

Platform 21 is supported by a frame that has deep skirts 22 at each side. These serve to mount the mechanism which operates the platform 21 and at the same time hide it and guard it from excess water. The skirts 22 are connected together by members 23 at each end. A wooden perimeter 24 is fixed to the top of the frame together with tubular handles 25. Two axles 26 are fixed low down between the skirts 22 and pivotally mounted on these are tubular crankshafts 27. Four levers or cranks are welded to each tubular shaft 26, two of them indicated by 28 being to transmit the power from the hydraulic ram 20 and the other pair respectively 29 and 30 to raise and lower the platform 21. The two crankshafts 27 are connected together by a link 31 which is also connected to the piston rod 32 of ram 20. The ram is a single acting type fed by hose 19 and is returned by spring 33. Levers 28 on each shaft are of identical length so that any movement of the piston rod 32 produces an equal rotation of each shaft 26.

Lever 29 is somewhat longer than lever 30 which results in a lesser movement of the pivot point of lever 30 than of lever 29. This arrangement thus produces the correct amount of movement to achieve an incline in the platform 21 when it is lowered. (see FIGS. 6 and 8). If parallel or horizontal movement of the platform 21 is required levers 29 and 30 would be of the same length. Levers 29 and 30 transmit force through the pivotally mounted link 34 and for sideways stability each pair of links is connected with a tubular member 35. These links are pivotally mounted to both the crankshaft levers 29 and 30 and to the platform frame 36.

Endwise stability is achieved by fixing a spigot 37 to the platform 21 and passing this through a clearance hole in a bracket 38 mounted on the main frame. The frame 36 of platform 21 is a welded structure of quare tube inset into which is a plywood or perforated metal base panel 39. At the foot end there is provided a drain 40 which has a flange clamped down on the surface of the flexible cover 43. Connected to the bottom end of the outlet drain 40 is a flexible hose 41.

Referring now to FIGS. 9 and 10, platform 21 is fitted with two sheets of foam padding 42 one of these fitting within frame 36 whilst the other overlays the frame. The wooden perimeter rail 24 is rounded at the top and this is also covered with padding 47. The overlay cover 43 is flexible, strong and waterproof, and can be laminate of two sheets of stretch vinyl material with fixing and tensioning flanges 48 and 49 respectively sewn to the underneath sheet with a second sheet bonded over the top of this. In preferred method the entire cover including its flanges is molded in one piece from rubber or plastics material. As the cover is open to damage during use it must be readily replaceable.

The periphery of the cover 43 is secured to the wooden rails 24 by stapling and the staples are then covered with a buffer padding rail (not shown). Cover 43 is secured to platform 21 by attaching the fixing flange 48 to the underside of the platform frame 36. The tensioning flange 49 is located down each side but not across the ends of cover 43 on a line that follows the lowest extremity of the side gutters 44 which form when platform 21 is raised (see FIG. 9). Flanges 49 have attached to them a series of tensioning devices 45 which are shown as springs but are preferably constructed from rubber elements. The purpose of these tensioning devices 45 is to hold the gutter 44 taut whilst the platform 21 is ascending so that a tidy appearance is achieved.

In the preferred from the width of these gutters 44 does not exceed 50 mm at which size they are not felt by the patient during transferal to a degree that is noticeable or uncomfortable.

In FIG. 1 the trolley is shown with a patient being transferred thereto. The platform unit 14 is in the lowered position and the platform 21 in its raised position. Once the patient is in place the ram 13 actuates the x linkage 11, 12 to raise the platform unit 14. Ram 20 is then actuated so that platform 21 lowers into the position shown in FIGS. 6, 8 and 10 whereupon the patient can be bathed as illustrated in FIG. 2. Sprayed and splashed water is kept within the perimeter of the platform unit 14 and is channelled to the drain 40 at the lowest point under the patient's feet. Water drains through pipe 41 and as illustrated into a conventional bath B.

After the patient has been showered the sloping platform 21 is elevated to the level position (FIG. 9) where he or she is dried. After this the platform unit 14 is lowered to allow the patient to be transferred to the wheelchair.

The text and drawings of the specification relate to a shower trolley which is a unit having a sloping platform 21 for continuous drainage of running water. However, the trolley can be varied as follows:

1. A bath trolley. For this application the patient support platform is made to lower to a horizontal low position rather than a sloping one. This is done by making lever 30 the same length as lever 29. With the addition of a plug water can be retained so that a patient could be semi-submerged.

2. A concealment trolley, for the transportation of cadavers through hospital corridors with the body totally concealed and the conveyance disguised to look like an empty trolley. In this instance the levers are arranged in the same way as in the bath trolley so that platform 21 lowers to a horizontal position. The body on the platform extends to a lower level than the perimeter of the unit 14 and a cover which has the appearance of a mattress is then placed over the top and tensioned to the perimeter. This conveys the impression of an empty trolley which can be wheeled through corridors without its purpose being evident to the casual observer.

The present invention provides a shower or bath trolley which has many advantages amongst which can be enumerated, 1. The operation is simple and easy, only requiring that a pedal be depressed.

2. A sloping base with taut walls is achieved so that water is readily conducted to the drain. The slope is also beneficial to the occupants comfort.

3. The perimeter barrier is strong, safe and comfortable being the padded structural frame of the platform unit.

4. The trough configuration is deep enough and of sufficient width to prevent water escaping or splashing onto the attendant.

5. The first padded base of the auxiliary platform allows patients to be turned easily with the soft walls ensuring his comfort.

What is claimed is:

1. A bath or shower apparatus comprising:

a platform;

a surround which extends about said platform;

a flexible waterproof flexible cover attached at the periphery thereof to said surround, a central area of said cover resting on and being attached to said platform;

means to move said platform between a raised position where the platform is substantially in the same plane as the surround and surplus material from said flexible cover is located between the surround and platform and a lowered position where the platform is below the level of the surround and there is maximum downward extension of the flexible cover; and means which downwardly tensions said surplus material when the platform is in said lowered position.

2. Apparatus as claimed in claim 1 wherein the means to raise and lower the platform is formed by a linkage mechanism attached to said platform and supported by a mounting frame which also supports said surround.

3. Apparatus as claimed in claim 2 wherein the linkage mechanism comprises a pair of spaced apart shafts pivotally mounted by said mounting frame, each shaft having a first pair of levers attached thereto by one end while the other ends of the levers are coupled to said platform, there being a further lever attached to each shaft but set at a different angular displacement relative to the axis of said shaft than the first levers, said further levers being coupled together by a link member.

4. Apparatus as claimed in claim 3 wherein the lengths of the said first levers are the same.

5. Apparatus as claimed in claim 3 wherein the lengths of the levers of one pair of said first levers are of different length to the levers of the other pair of said first levers.

6. Apparatus as claimed in claim 4 or 5 wherein said link member is coupled to a fluid actuated ram.

7. Apparatus as claimed in claim 1 wherein said platform is fitted with a resilient padding which is covered by said flexible cover, said cover being formed by a laminate of plastics material sheeting.

8. Apparatus as claimed in claim 1 wherein tensioning means couple said flexible cover to a fixture located at a level below that of the lowered position of said platform.

9. Apparatus as claimed in claim 7 or 8 wherein the flexible cover is securely fastened to said surround and said surround is in turn covered with a buffer padding.

10. Apparatus as claimed in claim 7 or 8 wherein an outlet drain is incorporated in said platform.

11. Apparatus as claimed in claim 2 wherein said mounting frame is carried by a wheeled bogey.

12. An apparatus as claimed in claim 11 wherein said mounting frame is supported on said bogey by a pair of pivotally coupled X linkages there being means whereby said X linkages can be adjusted to effect lifting and lowering of said mounting frame relative to said bogey.

13. Apparatus as claimed in claim 12 wherein said lifting and lowering means is a fluid actuated ram.

* * * * *